United States Patent [19]

Beiswenger

[11] 3,971,323

[45] July 27, 1976

[54] TAMPING BLADE AND A HARD WEAR-RESISTANT INSERT THEREFOR

[75] Inventor: Richard W. Beiswenger, Penn Hills Township, Pa.

[73] Assignee: Teledyne Mid-America Corporation, Los Angeles, Calif.

[22] Filed: Feb. 19, 1975

[21] Appl. No.: 551,042

[52] U.S. Cl. ..... 104/10; 172/719

[51] Int. Cl.[2] ..... E01B 27/00

[58] Field of Search ..... 104/1 R, 10, 12, 13, 104/14; 294/56; 37/141 R, 141 T, 142 R; 172/719, 745; 173/90; 175/409, 410, 411; 404/113, 133

[56] References Cited

UNITED STATES PATENTS

| | | | |
|---|---|---|---|
| 2,940,522 | 6/1960 | Taylor et al. | 175/410 X |
| 3,581,664 | 6/1971 | Kruse et al. | 104/10 |
| 3,729,055 | 4/1973 | Burridge | 104/10 X |
| 3,793,960 | 2/1974 | McKenry | 104/10 |
| 3,805,423 | 4/1974 | Engel et al. | 172/719 X |
| 3,826,025 | 7/1974 | Elliott | 104/12 X |

FOREIGN PATENTS OR APPLICATIONS

| | | | |
|---|---|---|---|
| 424,840 | 5/1967 | Switzerland | 37/141 R |

*Primary Examiner*—L. J. Paperner
*Assistant Examiner*—Randolph A. Reese
*Attorney, Agent, or Firm*—Reed Smith Shaw & McClay

[57] ABSTRACT

A tamping blade is comprised of a blade shoe of steel that is adapted for mounting on the end of a support arm and has a cut-out at the leading edges to support at least one wear-resistant insert. Preferably a plurality of wear-resistant inserts, typically of tungsten carbide, are positioned end to end in the cut-out. Each insert has first and second opposed sides and first and second opposed major surfaces, with the major surfaces being angular to each other to provide a substantially uniform thickness for the body at each of the sides. The first side of each insert has a thickness of at least about ⅜ inch and is adapted to provide a leading edge for the tamping blade extending across the thickness of the blade shoe beyond the leading edge thereof. The first major surface is adapted to provide a wear-resistant facing for the tamping blade during lateral movement, and the second side and the second major surface are adapted to support the insert in the cut-out of the blade for impact loading of the first side of the insert.

7 Claims, 8 Drawing Figures

TAMPING BLADE AND A HARD WEAR-RESISTANT INSERT THEREFOR

FIELD OF THE INVENTION

The present invention relates to a tamping blade having a long useful life.

BACKGROUND OF THE INVENTION

Tamping machines are used to repair and correct the ballast around and beneath railroad ties so that the roadbed can uniformly support the passage of railroad trains over it. Tamping machines are designed to move along the roadbed and at each tie to force at least eight tamping blades into the ballast, one blade on each side of each tie on each side of each rail. The tamping blades are then vibrated and moved toward the tie in unison to compact the ballast under the tie and provide a firm formation around and beneath the tie. The railroad bed in turn provides a solid foundation for the heavy loads encountered as a train passes thereover.

A primary difficulty is that the typical ballast materials are highly abrasive, e.g. sand, slag, gravel and cinders. The leading edges of the tamping blades wear away rapidly, and the tamping blades must be replaced or the leading edges of the tamping blades rebuilt. See e.g. U.S. Pat. No. 3,826,025. Typically, the edges of the tamping blades are faced with a high chromium-steel braze to provide added wear resistance. Yet, even with chromium-steel facing, a noraml run is only 4 to 6 miles of roadbed before the edges of the tamping blades are worn to the point where replacement is necessary for efficient operation.

The life of the tamping blades have been substantially increased by providing a tungsten carbid insert in the leading edge of the tamping blade. Such a tamping blade is described in U.S. Pat. No. 3,793,960, issued Feb. 26, 1974. The carbide insert is nested and brazed into a groove formed in the leading edge of the blade. The carbide insert is of sufficient bulk and is adequately supported by the surrounding groove to avoid chipping, cracking and spalling of the insert under the heavy impact loading to which the leading edge of the blade is exposed.

This construction substantially increases the life of the tamping blade; such blades are, however, still limited in their useful life. Because of the necessity for the groove-nested insert, the blade does not have a wear-resistant facing across the entire leading edge. Moreover, such blades have no wear-resistant facing to protect the blade during lateral movement through the ballast. As a result, such blades wear rapidly and eventually "wash-out" at the edges of the groove supporting the insert, thereby requiring replacement of the entire tamping blade.

The present invention overcomes these difficulties and disadvantages, and provides a tamping blade with a substantially prolonged useful life. A carbide insert provides a hard wear-resistant facing across the entire leading edge of the tamping blade and the lateral facing of the blade, while supporting the insert so as not to crack, spall or chip on impact loading.

SUMMARY OF THE INVENTION

A tamping blade is provided that has a blade shoe of steel adapted for mounting on the lower end of the tamping arm. The blade shoe has a cut-out at and typically the length of the leading edge thereof to support a wear-resistant insert. A wear-resistant insert is rigidly positioned in the cut-out of the blade shoe typically by brazing be well-known techniques.

The wear-resistant insert is comprised of a body of hard wear-resistant material, typically tungsten carbide. The body has first and second opposed sides and first and second opposed major surfaces, with said major surfaces being angular to each other to provide a substantially uniform thickness for the body at each said side. As more fully described hereafter, the angular surface provides support for the insert without exposing the leading edge of the blade shoe to abrasion and wear during use.

The first side of the insert has a thickness of at least about ⅜ inch, is preferably rounded, and extends across the thickness of the blade shoe beyond the leading edge thereof to provide a leading edge for the tamping blade. The first major surface, preferably of at least one inch in width, is adapted to provide a wear-resistant facing for the tamping blade during lateral movement through the ballast toward the tie.

The insert is supported on the blade shoe by said second side and said second major surface for impact loading of the leading edge of the tamping blade. Preferably, the body is at least 1/16 inch thick at the second side. This construction, together with the angular position of the second major surface relative to the first major surface is preferred to support the insert in the cut-out of the blade for impact loading of the first side of the insert, i.e. the leading edge of the tamping blades.

Preferably, a plurality of inserts extend end to end along the length of the leading edge of the blade shoe. The insert is typically made by pressing and sintering by established techniques. Such techniques involve substantial shrinkage of the insert during manufacture and warpage occurs if any dimension of the insert is too large. For this reason, it is preferred that the length of the insert be kept small, and a plurality of inserts be positioned end to end to extend the length of the leading edge of the blade shoe.

Other details, objects and advantages of the invention will become apparent as the following description of the presently preferred embodiments of the invention and presently preferred ways of making and practicing the same proceeds.

BRIEF DESCRIPTION OF THE DRAWINGS

In the accompanying drawings, the presently preferred embodiments of the invention and the presently preferred ways of making and practicing the invention are illustrated, in which.

DESCRIPTION OF THE PREFERRED EMBODIMENTS

Figure 1:
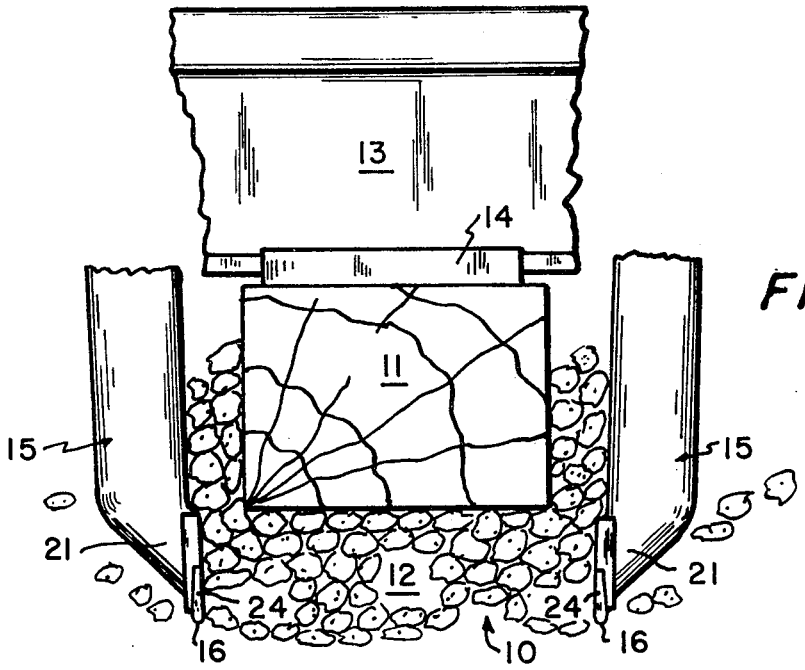
FIG. 1 is a fragmentary, schematic side view showing the operation of tamping blades embodying the present invention.

Referring to FIG. 1, a conventional roadbed 10 is comprised of a plurality of spaced apart, substantially parallel roadbed ties, such as tie 11, embedded in ballast 12. Rails 13 are supported on rail plates 14, which are in turn supported on ties 11. When the roadbed requires leveling, a tamping machine (not shown) of known construction is rolled along rails 13, and a plurality of support arms (not shown) are manipulated and deployed by suitable hydraulic power means at each tie in turn. At least eight and typically 16 tamping shoes 15 are individually extended from the support arms, with at least one and typically two blades on each side of each rail 13 on the side of tie 11. Each tamping blade 15 has a leading edge 16 which is forced into ballast 12 as shown. Tamping blades 15 are thereafter vibrated and moved toward tie 11 in unison to raise the tie to a fixed level while tamping the ballast under the tie.

Figure 2:
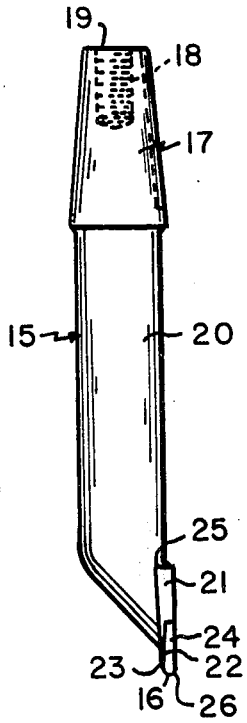
FIG. 2 is a side view of a tamping blade embodying the present invention.
Figure 3:
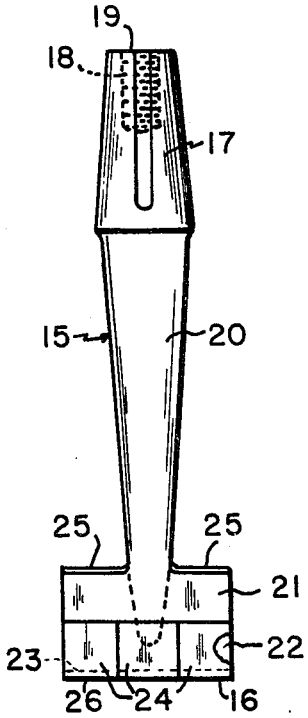
FIG. 3 is an elevational view of the tamping blade shown in FIG. 2.
Figure 4:
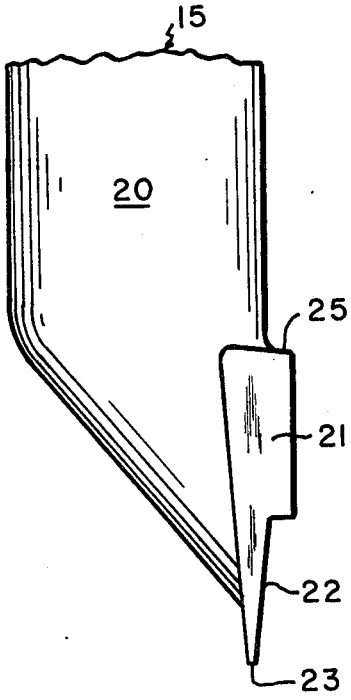
FIG. 4 is an enlarged fragmentary side view of the leading edge of the tamping blade shown in FIG. 2, without the tamping blade insert of the present invention.

Referring to FIGS. 2 and 3, tamping blade 15 is shown in more detail. Blade 15 has support shaft portion 17 that has a threaded opening 18 in the end 19 thereof to fasten the blade to a corresponding support arm. Blade 15 also has tapered stem portion 20 extending to an integral blade plate or shoe 21 at the opposite end thereof. Blade shoe 21 has recess or cut-out 22 (see FIG. 4) extending across leading edge 23 (which is also leading edge 16 of tamping blade 15), into which tamping blade inserts 24 are welded end to end (see FIGS. 7 and 8). Typically, shoe 21 is about 4 inches long, about 3 inches wide, and about ⅜ to ⅝ inch in thickness from leading edge 23 to trailing edge 25, respectively.

Tamping blade 15 may be a new blade drop forged with cut-out 22 for support of blade inserts 24. Alternatively, tamping blade 15 may be made from an existing blade by milling cut-out 22 in leading edge 16. In either embodiment, cut-out 22 is typically about 1½ inches wide and about ⅜ to ⅛–1/16 inch deep from leading edge 23 toward trailing edge 25, respectively.

Figure 5:
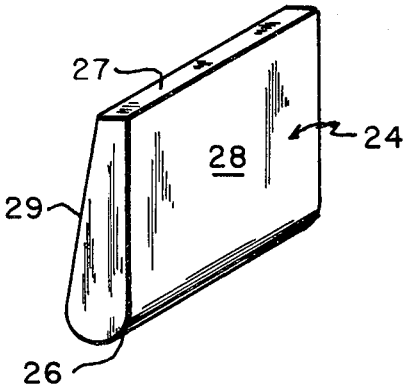
FIG. 5 is an enlarged perspective view of the tamping blade insert of the present invention.

Referring to FIG. 5, tamping blade insert 24 is shown in more detail. Insert 24 is comprised of a body of hard wear-resistant material having first and second sides 26 and 27, respectively, and first and second, preferably planar major surfaces 28 and 29, respectively. Major surfaces 28 and 29 are preferably at least 1 inch in width. Major surfaces 28 and 29 are angular to each other to provide a substantially uniform thickness for the body at each side 26 and 27. First side 26 is adapted to provide leading edge 16 for tamping blade 15 extending across the thickness of leading edge 16. First side 26 is preferably rounded and curvilinear, and has a thickness of at least about ⅜ inch to enable the tamping blade to withstand the impact loading to which the blade is subjected when forced into ballast 12. First major surface 28 is adapted to provide a wear-resistant facing for the tamping blade during lateral movement of the tamping blade toward tie 11 as shown in FIG. 1.

Figure 7:
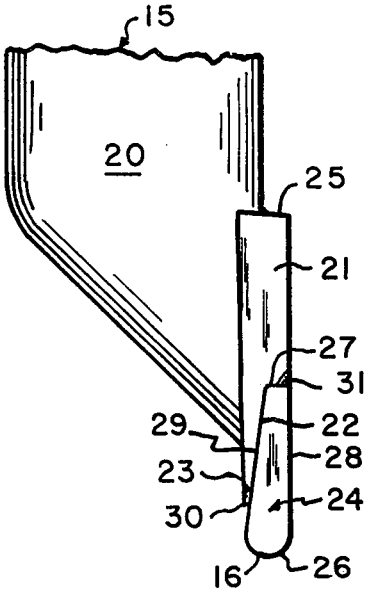
FIG. 7 is an enlarged fragmentary side view of a leading edge of the tamping blade shown in FIG. 2.
Figure 8:
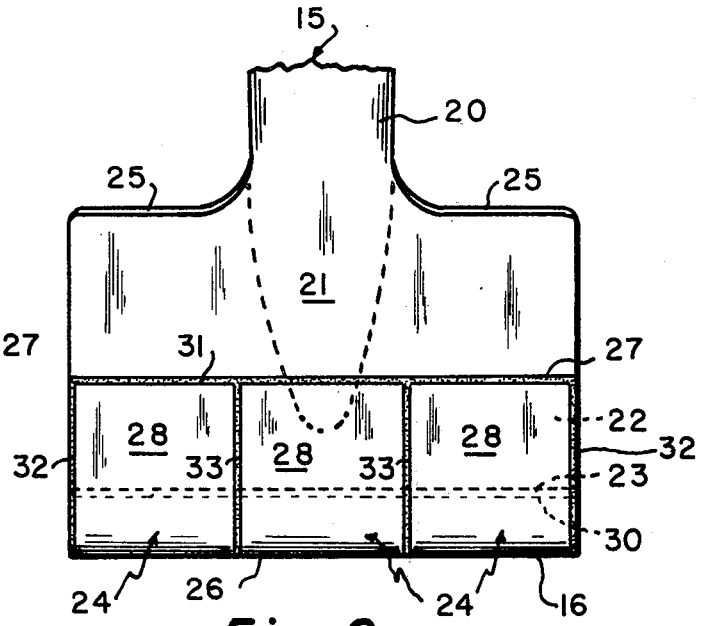
FIG. 8 is an enlarged fragmentary elevational view of the leading edge of the tamping blade insert shown in FIG. 2.

Second side 27 and second major surface 29 are adapted to support insert 24 in cut-out 22 of tamping shoe 21 of tamping blade 15 as shown most clearly in FIGS. 7 and 8. Second side 27 is at least about 1/16 inch and typically about ⅛ inch in thickness to provide support for the insert during impact loading of tamping blade 15 when leading edge 16 is forced into ballast 12 without chipping and cracking the insert. The angular position of second major surface 29 relative to first major surface 28 supports insert 24 in cut-out 22 of blade shoe 21 during lateral movement of tamping blade 15 through ballast 12.

Tamping blade insert 24 is preferably made of tungsten carbide by establishing sintering techniques. That is, a powder of tungsten carbide is molded under pressure and thereafter fired in a sintering furnace to a hard wear-resistant body. The difficulty with the sintering of tungsten carbide is that substantial shrinkage occurs. The inserts must, therefore, be maintained relatively small to avoid warpage from occurring in any dimension. For this reason, it is preferred that the length of the insert be kept small, and a plurality of inserts be positioned end-to-end along preferably the entire length of the leading edge of the blade shoe as best shown in FIG. 8.

Figure 6:
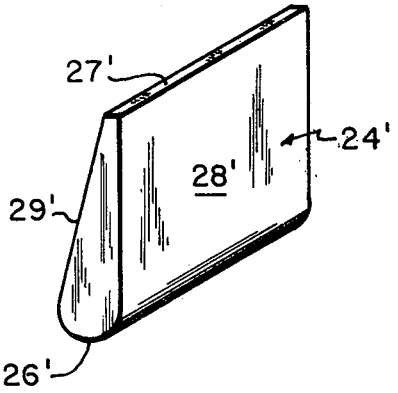
FIG. 6 is an enlarged perspective view of an alternate tamping blade insert of the present invention.

Referring to FIG. 6, an alternative embodiment of the tamping blade insert of the present invention is shown. Tamping blade insert 24′ is identical except for dimensions to blade insert 24 and, therefore, need not be redescribed. The parts and features are given prime numbers corresponding to the numbered parts and features described in connection with FIG. 5. The difference is that major surfaces 28′ and 29′ are more angular to each other so that the insert has a substantially uniform thickness of about 1/16 inch at second side 27′, which is the minimum thickness preferable for second side 27′ to avoid chipping and cracking of the insert under the impact loading to which the insert is subject on forcing the tamping blade into the ballast.

Irrespective of the embodiment, the tamping blade insert may be assembled with the tamping blade in any suitable way. Preferably the inserts are assembled with the tamping blade as shown in FIGS. 7 and 8. But-end 30 and bevel 31 are provided along body and trailing edges of cut-out 22 to provide for easy welding of the inserts into the cut-outs end-to-end as shown. Bevels 32 are provided at the ends of tamping shoe 21, and spaces 33 are provided between the ends of adjacent tamping inserts 24 to further rigidly weld the tamping inserts into cut-out 22.

While the presently preferred embodiments of the invention and the methods for performing and making them have been specifically described, it is distinctly understood that the invention may be otherwise variously embodied and used within the scope of the following claims.

What is claimed is:

1. A tamping blade insert comprising:

A. a body of hard wear-resistant material having first and second opposed sides and first and second opposed major surfaces, said surfaces being angular to each other to provide a substantially uniform thickness for the body at each side;

B. said first side of the body having a thickness of at least about ⅜ inch and adapted to provide a leading edge for a tamping blade extending across the thickness of the leading edge of said tampiing blade, and said first major surface being adapted to provide a wear-resistant facing for said tampiing blade during lateral movement; and C. said second side and said second major surface being adapted to support the body on said tamping blade for impact loading of said first side of the body.

2. A tamping blade insert as set forth in claim 1 wherein:

i. the body is at least one inch in width;

ii. said first side of the body is rounded; and iii. said second side of the body is at least 1/16 inch in thickness.

3. A tamping blade insert as set forth in claim 2 wherein:

the body consists of tungsten carbide.

4. A tamping blade comprising:

A. blade shoe of steel adapted for mounting on an end of a support arm, said blade shoe having a cut-out at a leading edge thereof to support a wear-resistant insert;

B. at least one wear-resistant insert rigidly positioned in said cut-out of the blade shoe, said insert being of hard wear-resistant material and comprising:

1. first and second opposed sides and first and second opposed major surfaces with said surfaces being angular to each other to provide a substantially uniform thickness for the body at each side;

2. said first side of the insert having a thickness of at least about ⅜ inch and adapted to provide a leading edge for the tamping blade by extending across the thickness of said blade beyond the leading edge of the blade shoe, and said first major surface being adapted to provide wear-resistant facing for said tamping blade during lateral movement; and 3. said second side and said second major surface of the insert being adapted to support the insert in the cut-out of the blade shoe for impact loading of said first side of the insert.

5. A tamping blade as set forth in claim 4 wherein:

the wear-resistant inserts extend the length of the leading edge of the blade shoe.

6. A tamping blade as set forth in claim 5 wherein:

i. the insert is at least one inch in width;

ii. said first side of the insert is rounded; and iii. said second side of the insert is at least 1/16 inch in thickness.

7. A tamping blade as set forth in claim 6 wherein:

the insert consists of tungsten carbide.

* * * * *